US005681107A

United States Patent [19]

Wang

[11] Patent Number: 5,681,107

[45] Date of Patent: Oct. 28, 1997

[54] STRUCTURE FOR A DECORATIVE LAMP

[76] Inventor: Chih-Tung Wang, P.O. Box 96-405, Taipei, Taiwan, 10098

[21] Appl. No.: 730,683

[22] Filed: Oct. 11, 1996

[51] Int. Cl.[6] ..... F21V 21/00

[52] U.S. Cl. ..... 362/249; 439/375; 439/602; 439/699.2; 362/391

[58] Field of Search ..... 362/391, 249; 439/280, 602, 699.2, 375

[56] References Cited

U.S. PATENT DOCUMENTS 5,580,159 12/1996 Liu ..... 362/249

*Primary Examiner*—Carroll B. Dority

[57] ABSTRACT

An improved structure for a decorative lamp, in which an end opening of a cylinder part under the socket for inserting power wires is provided with two sets of positioning slots having different depth; each of the positioning slots is furnished with a guide slot between the inside and the opening thereof; the diameter of the guide slot is slightly less than that of the positioning slot; the set of deep positioning slots is used for laying and fastening two power wires respectively; a fixing cap to be assembled with cylinder part of the socket is furnished with two semi-circular posts in the central part thereof; the outer part of the fixing cap is provided with a round flange; at least two positioning studs are furnished between the bottom part of the semi-circular posts and the round flange; the positioning studs are to be mated with the shallow positioning slots on the end opening of the cylinder part of the socket. The round flange of the fixing cap is provided with at least two pairs of high flange studs opposite to the end opening of the deep positioning slots on the socket respectively; between two high flange studs, there is a round slot. The power wires pulled out of the socket are to be laid through the round slots between the high flange studs so as to be fastened in place respectively.

1 Claim, 3 Drawing Sheets

STRUCTURE FOR A DECORATIVE LAMP

BACKGROUND OF THE INVENTION

1. Field of the Invention

This invention relates to a decorative lamp for Christmas season, and particularly to a decorative lamp having a structure for fastening a socket and a fixing cap together.

2. Description of the Prior Art

In the conventional decorative lamp string for Christmas, the two copper wires of a small bulb are plugged through holes in a sleeve socket, and then are bent towards two sides of the sleeve socket. In a socket for mounting the sleeve socket, the ends of two power wires are attached with two copper plates respectively; the two copper plates are fixedly mounted to the plug-in seat of the socket respectively. After the small bulb is plugged into the plug-in seat, the two copper wires bent will be in contact with the copper plates respectively; a plurality of such sockets are connected into a string by means power wires. The decorative lamps in such string are connected in series; each small bulb in each socket requires a low voltage without causing an electric shock; however, such a string of lamps is usually installed and used outdoors; the contact part between the filaments of bulb and the copper plates is subject to having rust as a result of moisture to cause the bulb out of power.

SUMMARY OF THE INVENTION

The prime object of the present invention is to provide an improved structure for a decorative lamp for Christmas season, in which the socket for receiving bulb and a connecting seat has an end opening on the cylinder part for inserting power wires, and the end opening is provided with two sets of positioning slots in different depth; each positioning slot has a guide slot to the opening thereof; the width of the guide slot is slightly less than the diameter of the positioning slot; one set of deeper positioning slots are used for laying and fastening two power wires in place; the other set of shallow positioning slots are to be mated with the positioning studs of the fixing cap; the outer surface of the end opening of the cylinder part is to be covered with the round flange of the fixing cap. The round flange is furnished with two symmetrical round slots opposite to the pulling out point of the power wires so as to have the round slots fastened to the outer surface of the power wires.

Another object of the present invention is to provide an improved structure for a decorative lamp for Christmas season, in which the socket has cylinder part on one end for inserting the power wires; the end opening of the cylinder part is furnished with a set of deeper positioning slots for receiving the two power wires by means of the openings thereof upon pulling out of the socket; upon being pressed slightly, the power wires will be pushed into the positioning slots respectively, and will be in close contact with the inner surface of the positioning slots.

Still another object of the present invention is to provide an improved structure for a decorative lamp for Christmas season, in which the central part of the fixing cap is furnished with two symmetrical semi-circular posts, between which there is a channel part; both ends of the channel part are furnished with two power wire slots respectively opposite to the positioning slots. After the fixing cap being assembled together with the socket, the power wire slots of the fixing cap will separate the two power wires from each other. By means of the round slots of the round flange, the power wires will be fastened in place.

A further object of the present invention is to provide an improved structure for a decorative lamp for Christmas season, in which the end opening of the cylinder part in the socket is furnished with two shallow positioning slots in arch shape; the width of the opening of the slots is slightly less than the diameter of the positioning slot; after the fixing cap and the socket being assembled together, the symmetrical positioning studs inside the round flange will be mated with and fastened into the positioning slots of the socket respectively.

A still further object of the present invention is to provide an improved structure for a decorative lamp for Christmas season, in which a bottom channel is furnished between the semi-circular posts in the central part thereof and the round flange thereof, and the bottom channel is used for mounting the cylinder part of the socket so as to let the round flange cover the cylinder part of the socket.

DETAILED DESCRIPTION OF THE PREFERRED EMBODIMENT

Figure 1:
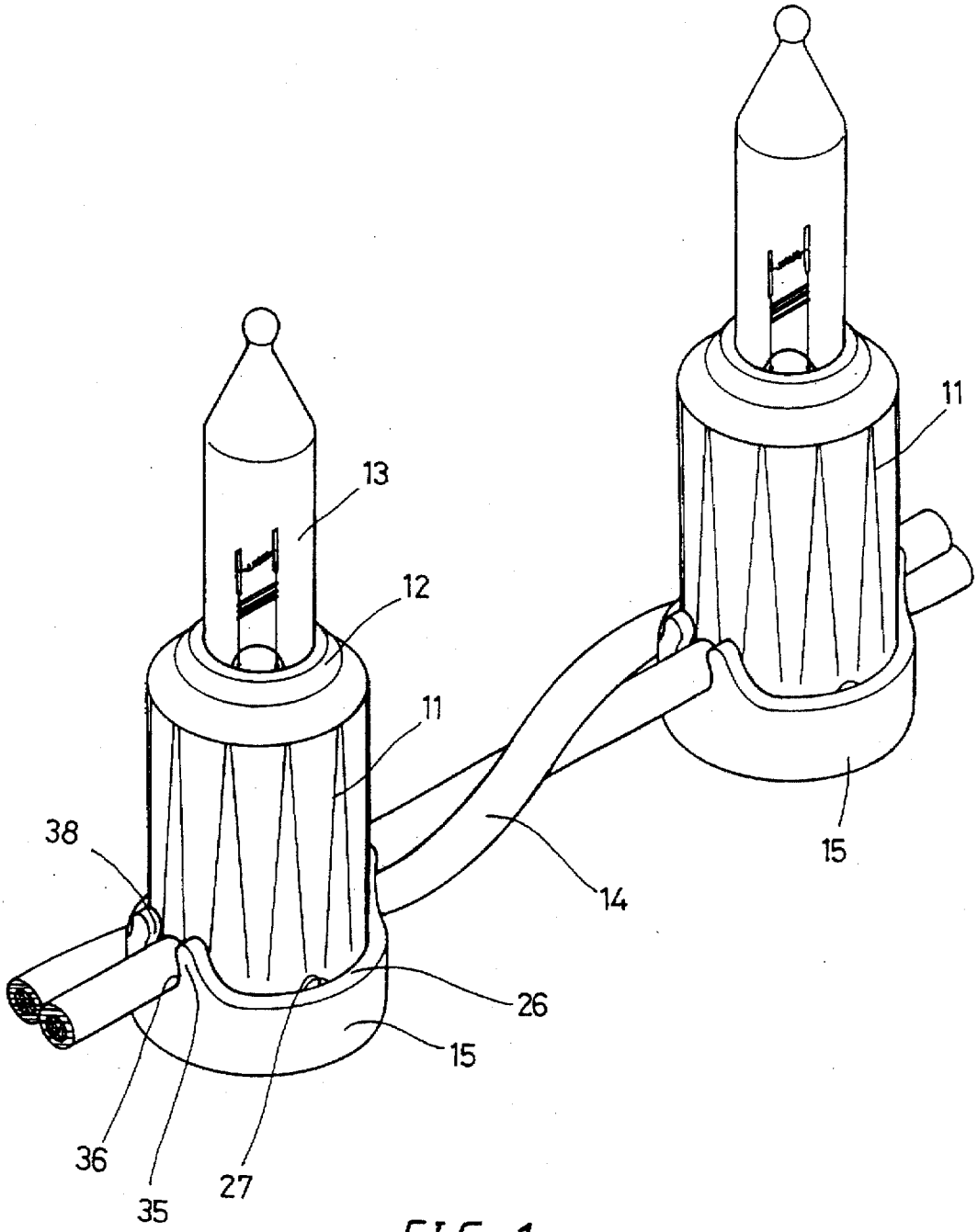
FIG. 1 is a perspective view of the present invention, showing a string of decorative lamps.
Figure 3:
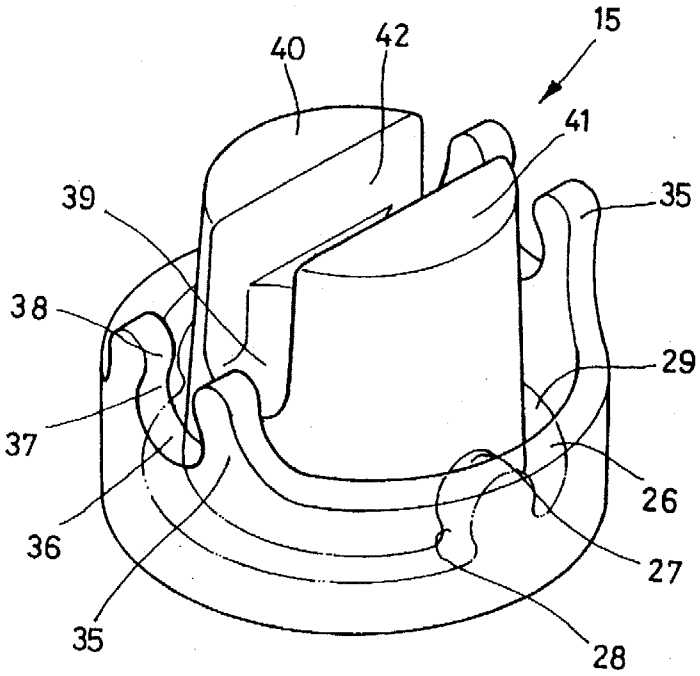
FIG. 3 is an enlarged disassembled view of the fixing cap according to the present invention.
Figure 2:
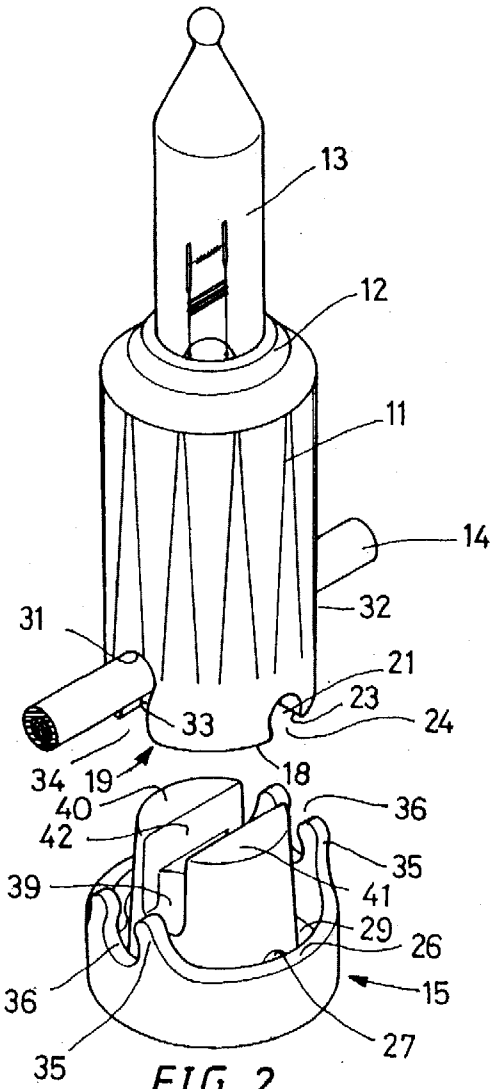
FIG. 2 is a disassembled view of the present invention, showing the socket and the fixing cap being disassembled from each other.
Figure 4:
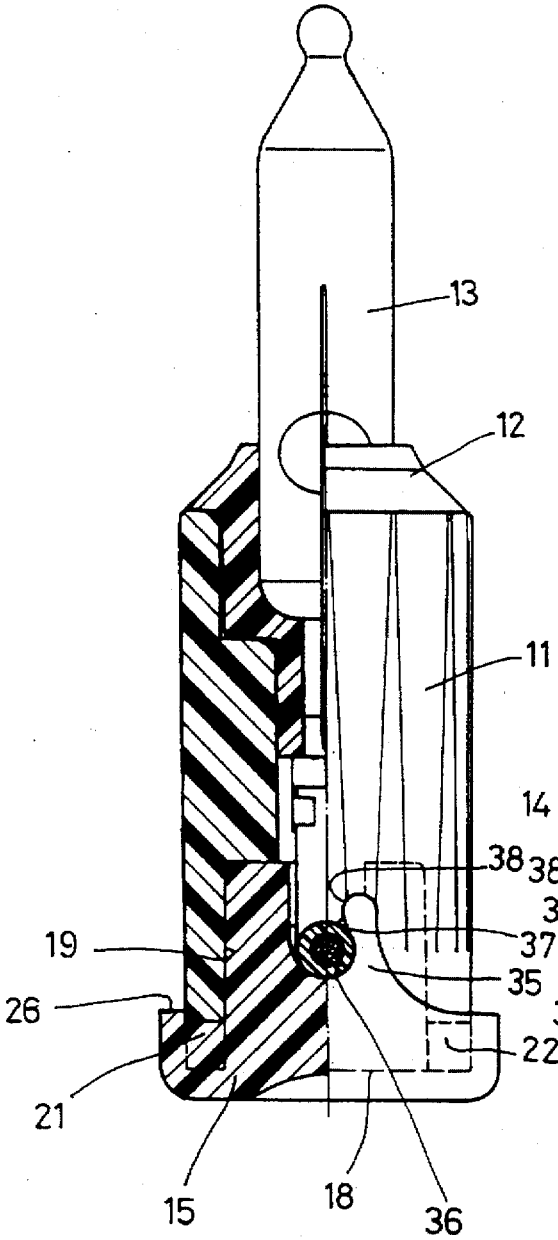
FIG. 4 is a sectional view of the present invention, showing the connected relation between the socket and the fling cap thereof.
Figure 5:
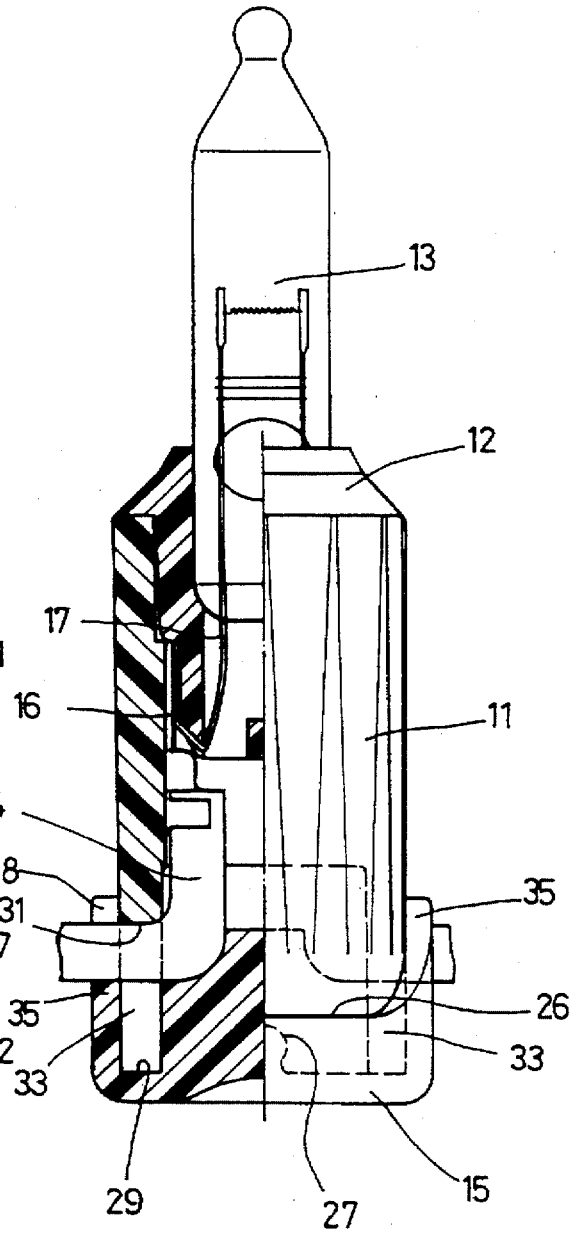
FIG. 5 is another sectional view of the present invention, showing the connected relation between the socket and the fixing cap thereof.

This invention relates to an improved structure for a decorative lamp; as shown in FIGS. 1, 4 and 5, the decorative lamp comprises a socket 11, a connecting seat 12, a bulb 13, power wires 14 and a fixing cap 15. The terminals of the power wires 14 are attached with copper plates 16 respectively; such copper plates 16 are fixedly mounted on positioning seats in the socket 11 respectively. One end of the socket 11 is an opening end to facilitate the connecting seat 12 with a bulb 13 to plug in so as to have two filaments 17 outside the connecting seat 12 and the copper plates 16 of the copper wires 14 contacted respectively. The other end of the socket 11 is furnished with two positioning slots 31 and 32 in symmetrical position so as to facilitate two power wires 14 to pull out respectively and to be fixed in place. The end of the socket 11 is to be closed with a fixing cap 15, which can cover the socket 11 by simply pressing the cap in place.

Referring to FIGS. 1, 2, 4 and 5, the power-wire plug-in end of the socket 11 has a cylinder part 19 having a given depth for receiving the symmetrical semi-circular posts 40 and 41 in the central part of the fixing cap 15. The end opening 18 of the cylinder parts 19 is provided with symmetrical positioning slots 21, 22, 31 and 32, in which the positioning slots 21 and 22 are shallow slots, while the positioning slots 31 and 32 are deep slots. The shallow slots 21 and 22 are used to have the fixing cap 15 and the socket 11 fastened together, while the deep slots 31 and 32 each have an elongate guide slot 33 and an opening 34. The bottom diameters of the positioning slots 31 and 32 are equal to or slightly less than that of the power wire 14. After the copper plates 16 on the power wires 14 are inserted in place, the power wires 14 should be put to the openings 34 of the positioning slots 31 and 32, and pulled towards the positioning slots 31 and 32 respectively; the power wires 14 will pass through the guide slots 33 easily respectively, i.e., the wires 14 being fastened in the positioning slots 31 and 32 closely and tightly.

As shown in FIGS. 2 to 5, the fixing cap 15 of the socket 11 has two symmetrical semi-circular posts 40 and 41; the diameter of the two semi-circular posts 40 and 41 is equal to or slightly less than that of the cylinder part 19 of the socket 11. The bottom part of the two semi-circular posts 40 and 41 is provided with a bottom channel 29 with a round flange 26; between the bottom end and the round flange 26, there are two symmetrical positioning studs 27. After the fixing cap 15 is mounted under the lower end of the socket 11, the two semi-circular posts 40 and 41 will be fitted in the cylinder part 19 of the socket 11, and then the bottom channel 29 will be in close contact with the end opening 18 of the cylinder part 19; then, the round flange 26 will be in contact with the outer surface of the socket 11. By using a suitable material, the socket 11 and the fixing cap 15 will be in close and water-proof contact.

Between the two semi-circular posts 41 and 42 in the central part of the socket 11, there is a channel part 42; both ends of the channel part 42, have two power wire slots 39 respectively. On the opposite side of each power wire slot 39, there are two high flange studs 35 and a round slot 36 furnished between the two studs 35. After the fixing cap 15 and the socket 11 are assembled together, the channel part 42 between the two semi-circular posts 40 and 41 and the power wire slots 39 will be formed into a guide passage for the power wires 14; the round slots 36 between the high flange studs 35 of the round flange 26 will fit on the outer surface of the power wires 14 without hindering the connection between the semi-circular posts 40 and 41 and the cylinder part 19 of the socket 11.

The round slot 36 between the high flange studs 35 opposite to the power wire slot 39 has an opening 38 with a guide slot 37. After the fixing cap 15 and the socket 11 are assembled together, the two power wires 14 will be laid in the two power wire slots 39 respectively; the two power wires 14 mounted in the two positioning slots 31 and 32 will be in contact with the openings 38 of the round slots 36 respectively. When pressing the fixing cap 15, the round slots 36 and the guide slots 37 will be fastened together with the power wires 14 respectively; the power wires 14 will be fixed in place along the round slots 36, the power wire slots 39 and the copper plates 16 respectively, i.e., the two power wires 14 will be fastened properly without un-intentional contact each other.

The end opening 18 of the socket 11 is provided with two shallow positioning slots 21 and 29; the lowest end of the socket is formed into a cylindrical part with a guide slot 23 and an opening 24; the width of the guide slot 23 is slightly less than the diameter of the positioning slot 21 or 22; the opening 24 and the guide slot 23 are formed into a round arch. Between the bottom end of the semi-circular posts 40 and 41 and the round flange 26, there are positioning studs 27, of which each has a cylindrical part and a neck part 28. When the fixing cap 15 and the socket 11 are assembled together, the outer surface of the positioning stud 27 will be in contact with the opening 24 of the socket 11; at the same time, the openings 38 of the positioning slots 31 and 32 of the round flange 26 in the fixing cap 15 will be in contact with the power wires 14; by means of a pressing force, the positioning stud 27 will, through the guide slots 23, be guided to fit into the positioning slots 21 and 22 respectively, and then the openings 38 contacted with the power wires 14 will, through the guide slots 37, be connected together with the positioning slots 31 and 32 respectively.

The deep positioning slots 31 and 32 of the socket 11 are used for fastening the two power wires 14 respectively. The power wires 14 on the outer surface of the positioning slots 31 and 32 will be covered with the round flange 26, and fastened in place with the round slot 36. The shallow positioning slots 21 and 22 ate be fastened together with the positioning studs 27 in the round flange 26 so as to provide a better contact between the fixing cap 15 and the socket 11.

The embodimeht of the present invention has been described in detail to disclose the features and structure thereof; it is apparent that the present invention has shown the improvement thereof, which is never anticipated and accomplished by others so far; the structure of the present invention is deemed unique.

I claim:

1. An improved structure for a decorative lamp comprising a socket, a connecting seat, a bulb, power wires and a fixing cap; end of each said power wires is connected with a copper plate to be fastened to a positioning seat in a cylinder part of said socket; one end of said socket including said connecting seat with said bulb, and said bulb being connected with copper plates of said power wires; the other end of said socket being furnished with a plurality of positioning slots to facilitate said fixing cap being fastened to one end of said socket;

a central part of said fixing cap having two semi-circular posts, and at a lower end of said semi-circular posts having a bottom channel and a round flange; at least two positioning studs being provided between said lower end of said semi-circular posts and said round flange; a channel part furnished between said two semi-circular posts, and both ends of said channel part furnished between said two semi-circular posts, and both ends of said channel part furnished with power wire slots respectively; two high flange studs being provided on said round flange opposite to each said power wire slot; said high flange studs forming a round slot for mounting said power wires in place;

said other and lower end of said socket being cylindrical and furnished with two sets of positioning slots having different depths and each set of said positioning slots having a guide slot and an opening; width of said guide slot being slightly less than diameter of said positioning slot; said set of deep positioning slots being used for laying said two power wires pulled out of said cylindrical end and fastening in said positioning slots respectively;

said two semi-circular posts located in a central part of said fixing cap being plugged in said cylindrical end of said socket, and said power wire slots between said semi-circular posts being used for laying said power wires in said cylindrical end of said socket; said positioning studs on said bottom channel to be mated with said shallow positioning slots respectively; said openings of said round slots on said round flange opposite to said power wire slots to be in contact with said power wires respectively; after said fixing cap is pressed in said cylindrical end of said socket, said round flange covering around said end opening of said cylindrical end of said socket.

* * * * *